US005348701A

United States Patent [19]

Ohdake et al.

[11] Patent Number: 5,348,701

[45] Date of Patent: Sep. 20, 1994

[54] VIBRATION-DAMPING ALLOY

[75] Inventors: Takayuki Ohdake; Toshimichi Ohmori; Toshihiro Takamura; Takemi Yamada; Tetsuya Sâmpei, all of Tokyo, Japan

[73] Assignee: NKK Corporation, Tokyo, Japan

[21] Appl. No.: 847,058

[22] Filed: Apr. 2, 1992

[30] Foreign Application Priority Data

Aug. 4, 1990 [JP] Japan ..... 2-207104

[51] Int. Cl.[5] ..... C22C 38/06; C22C 38/02

[52] U.S. Cl. ..... 420/73; 420/103

[58] Field of Search ..... 420/73, 103

[56] References Cited

FOREIGN PATENT DOCUMENTS

| | | | |
|---|---|---|---|
| 4625139 | 7/1971 | Japan | 420/78 |
| 49-22328 | 2/1974 | Japan . | |
| 5035020 | 4/1975 | Japan | 420/103 |
| 50-70212 | 6/1975 | Japan . | |
| 51-6119 | 1/1976 | Japan . | |
| 52-803 | 1/1977 | Japan . | |
| 56-28982 | 7/1981 | Japan . | |
| 6052559 | 3/1985 | Japan | 420/78 |
| 6052562 | 3/1985 | Japan | 420/78 |

*Primary Examiner*—Deborah Yee
*Attorney, Agent, or Firm*—Nields & Lemack

[57] ABSTRACT

It is an object to provide a vibration-damping alloy which has a high power of damping vibration and can be used to make components of a structure, machine, etc. and reduce effectively any vibration thereof and the noise thereby produced.

The vibration-damping alloy of this invention contains those proportions of Al and Si which fall within the range defined by a series of points in any of FIGS. 1 to 6, and less than 0.1 wt. % Mn, the balance of its composition being Fe and unavoidable impurities. It preferably contains more than 0.5 wt. % Si, while not containing more than 0.01 wt. % of any of C, N, O, P and S.

5 Claims, 8 Drawing Sheets

VIBRATION-DAMPING ALLOY

TECHNICAL FIELD

This invention relates to a vibration-damping alloy which has a high power of damping vibration, and which can be used to make components of structures, machines, etc. and reduce effectively the vibration thereof and the noise thereby produced.

BACKGROUND ART

The vibration and noise which occur in our living environment have been pointed out as one of the causes of public nuisance, An increase in the accuracy required of a precision machine has given rise to the necessary for providing means for preventing the vibration of the machine itself, One of the approaches which have hitherto been made to cope with those problems and requirements is to use a material having an outstandingly high power of damping vibration (a vibration-damping material) for making any component that is a source of vibration, There have been developed a number of alloys which are macroscopically uniform and have a high power of damping vibration. The main examples thereof are flake graphite cast iron, iron-based alloys, a Mg—Ni alloy, Cu—Mn alloys and a Ni—Ti alloy. The iron-based alloy can be said from the standpoints of strength and cost to be practically the best material for any parts that are used in a large quantity.

The known iron-based alloys include an Fe—Al alloy as proposed in Japanese Patent Publication No. 803/1977. This alloy is claimed to have a high power of damping vibration if it contains 2 to 8% Al. Japanese Patent Publication No. 28982/1981 proposes an iron-based alloy containing 0.4 to 4% Si and 0.1 to 1.5% Mn, and having a ferrite grain size number of 5 or below, and states that the Si and Mn which it contains fix N to eliminate any hindrance to the motion of dislocations which absorb vibration energy.

The vibration-damping properties of the known alloys as hereinabove described are, however, not necessarily satisfactory for the recent requirements which call for a very high level of vibration damping.

Under these circumstances, I, the inventor of this invention, have found that an alloy made by adding a specific proportion of Al or Si, or particularly both, to Fe exhibits an outstandingly high power of damping vibration which has hitherto not been possible.

DISCLOSURE OF THE INVENTION

The vibration-damping alloy of this invention which is based on the above discovery has the composition which will hereunder be set forth:

(1) A vibration-damping alloy containing those proportions of Al and Si which fall within the range defined in FIG. 1 by the lines connecting points $A_4$ (Al: 7.05 wt. %; Si: 0.95 wt. %), $B_4$ (Al: 6.50 wt. % Si: 1.10 wt. %), $C_4$(Al: 4.70 wt. %; Si: 2.75 wt. %), $D_4$(Al: 2.25 wt. %; Si: 2.45 wt. %), $E_4$(Al: 0 wt. %; Si: 4.50 wt. %), $A_0$ (Al: 0 wt. %; Si: 0 wt. %) and $B_0$ (Al: 8.00 wt. %; Si: 0 wt. % ), and less than 0.1 wt. % Mn, the balance of its composition being Fe and unavoidable impurities;

(2) A vibration-damping alloy containing those proportions of Al and Si which fall within the range defined in FIG. 2 by the lines connecting points $A_6$ (Al: 7.40 wt. %; Si: 0.60 wt. %), $B_6$(Al: 4.75 wt. %; Si: 1.00 wt. %), $C_6$(Al: 3.75 wt. %; Si: 1.90 wt. %), $D_6$(Al: 2.15 wt. %; Si: 2.15 wt. %), $E_6$(Al: 0 wt. %; Si: 4.00 wt. % ), $A_0$ (Al: 0 wt. %; Si: 0 wt. % ) and $B_0$ (Al: 8.00 wt. %; Si: 0 wt. % ), and less than 0.1 wt. % Mn, the balance of its composition being Fe and unavoidable impurities;

(3) A vibration-damping alloy containing those proportions of Al and Si which fall within the range defined in FIG. 3 by the lines connecting points $A_8$ (Al: 6.30 wt. %; Si: 0 wt. %), $B_8$(Al: 6.30 wt. %; Si: 0.50 wt. %), $C_8$(Al: 2.75 wt. %; Si: 1.20 wt. %), $D_8$(Al: 0 wt. %; Si: 3.50 wt. %), $E_8$(Al: 0 wt. %; Si: 0.60 wt. %) and $F_8$(Al: 0.70 wt. %; Si: 0 wt. %), and less than 0.1 wt. % Mn, the balance of its composition being Fe and unavoidable impurities;

(4) A vibration-damping alloy containing those proportions of Al and Si which fall within the range defined in FIG. 4 by the lines connecting points $A_{10}$ (Al: 4.80 wt. %; Si: 0 wt. %), $B_{10}$(Al: 4.80 wt. %; Si: 0.70 wt. %), $C_{10}$(Al: 2.90 wt. %; Si: 1.00 wt. %), $D_{10}$(Al: 1.35 wt. %; Si: 2.05 wt. %), $E_{10}$(Al: 0.55 wt. %; Si: 2.00 wt. %), $F_{10}$(Al: 0 wt. %; Si: 2.40 wt. %), $G_{10}$ (Al: 0 wt. %; Si: 0.80 wt. %), $H_{10}$(Al: 0.55 wt. %; Si: 0.25 wt. %), $I_{10}$(Al: 1.60 wt. %; Si: 0.35 wt. %) and $J_{10}$(Al: 2.25 wt. %; Si: 0 wt. %), and less than 0.1 wt. % Mn, the balance of its composition being Fe and unavoidable impurities;

(5) A vibration-damping alloy containing those proportions of Al and Si which fall within the range defined in FIG. 5 by the lines connecting points $A_{12}$ (Al: 4.55 wt. %; Si: 0.10 wt. %), $B_{12}$(Al: 4.55 wt. %; Si: 0.60 wt. %), $C_{12}$(Al: 2.35 wt. %; Si: 1.00 wt. %), $D_{12}$(Al: 1.10 wt. %; Si: 1.95 wt. %), $E_{12}$(Al: 1.10 wt. %; Si: 1.35 wt. %) and $F_{12}$(Al: 2.40 wt. %; Si: 0.10 wt. %), or points $G_{12}$(Al: 0 wt. %; Si: 1.05 wt. %), $H_{12}$(Al: 0.60 wt. %; Si: 0.35 wt. %), $I_{12}$(Al: 0.90 wt. %; Si: 0.40 wt. %), $J_{12}$(Al: 0.30 wt. %; Si: 2.05 wt. %) and $K_{12}$(Al: 0 wt. %; Si: 2.30 wt. % ), and less than 0.1 wt. % Mn, the balance of its composition being Fe and unavoidable impurities; or (6) A vibration-damping alloy containing those proportions of Al and Si which fall within the range defined in FIG. 6 by the lines connecting points $A_{14}$ (Al: 4.15 wt. %; Si: 0.20 wt. %), $B_{14}$(Al: 4.15 wt. %; Si: 0.60 wt. %), $C_{14}$(Al: 2.30 wt. %; Si: 0.90 wt. %), $D_{14}$(Al: 1.20 wt. %; Si: 1.75 wt. %), $E_{14}$(Al: 1.20 wt. %; Si: 1.35 wt. %) and $F_{14}$(Al: 2.70 wt. %; Si: 0.20 wt. %), or points $G_{14}$(Al: 0 wt. %; Si: 1.15 wt. % ), $H_{14}$(Al: 0.60 wt. %; Si: 0.40 wt. %), $I_{14}$(Al: 0.80 wt. %; Si: 0.45 wt. %) and $J_{14}$(Al: 0 wt. %; Si: 2.20 wt. %), and less than 0.1 wt. % Mn, the balance of its composition being Fe and unavoidable impurities.

DETAILED DESCRIPTION OF THE INVENTION

The following is an explanation of the reasons for the limitations made on the composition of the alloy according to this invention.

Figure 7:
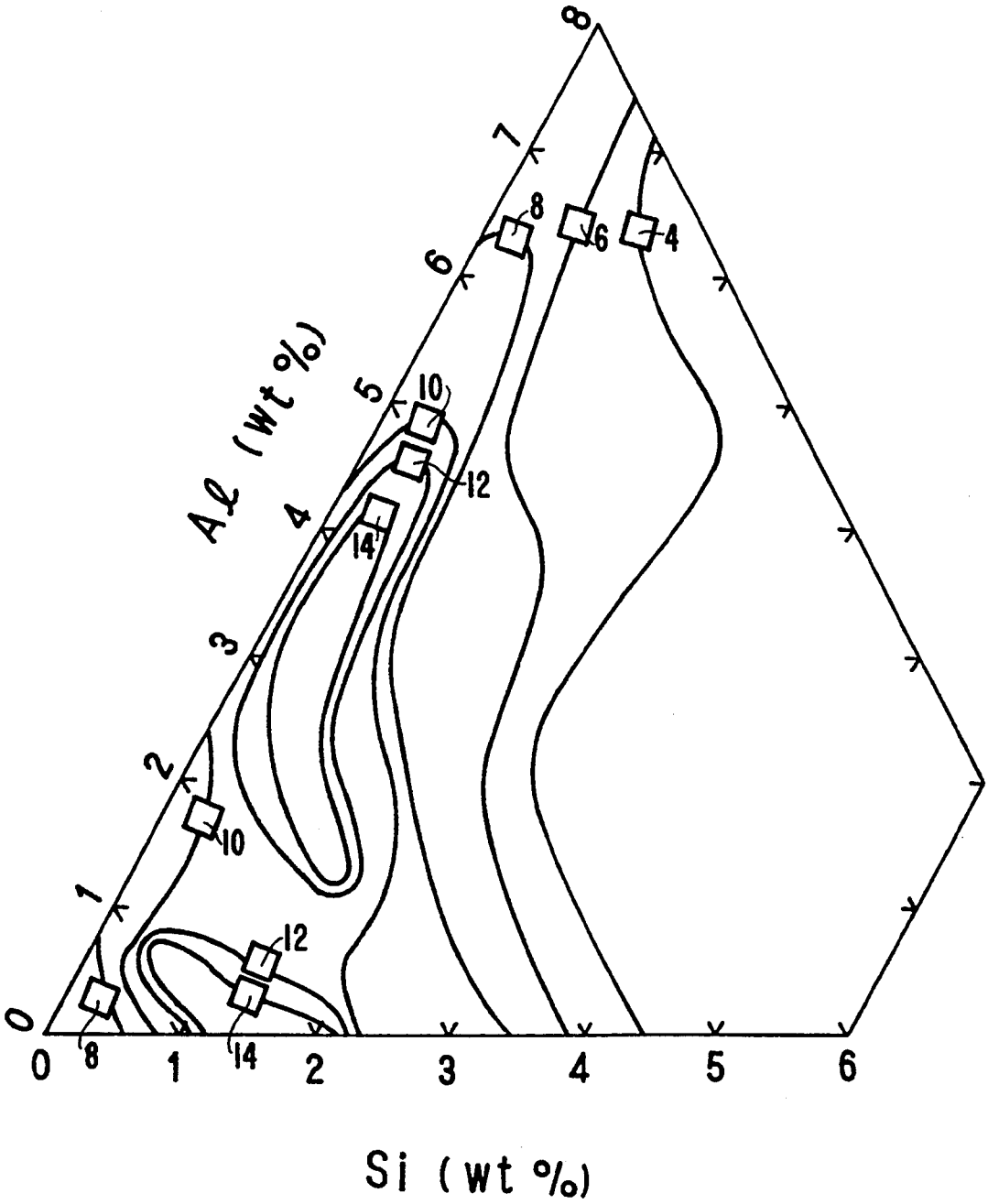
FIG. 7 is a diagram showing by contour lines the values of internal friction as determined of Fe—Al—Si alloys by the method which will hereinafter be identified as (1)

Most of the iron-based vibration-damping alloys rely for the absorption of vibrational energy upon the magneto-mechanical hysteresis resulting from the irreversible movement of magnetic domain walls by vibration. This characteristic is closely related to the magnetic properties of the alloy. On the other hand, it is known that the magnetic properties, such as permeability, of the Fe—Al—Si ternary alloys vary characteristically with their difference in composition, as was, for example, reported by Yamamoto in the Collection of Papers of The Society of Electrical Engineering, vol. 5 (1944), page 175. The values of internal friction ($Q^{-1}$) of these alloys were determined as a measure of their vibration-damping properties, and the results as shown in FIG. 7 were obtained. It is obvious therefrom that the addition of specific proportions of Al and Si to Fe enables so high vibration-damping properties as cannot be attained by the addition of only one of them.

Figure 8:
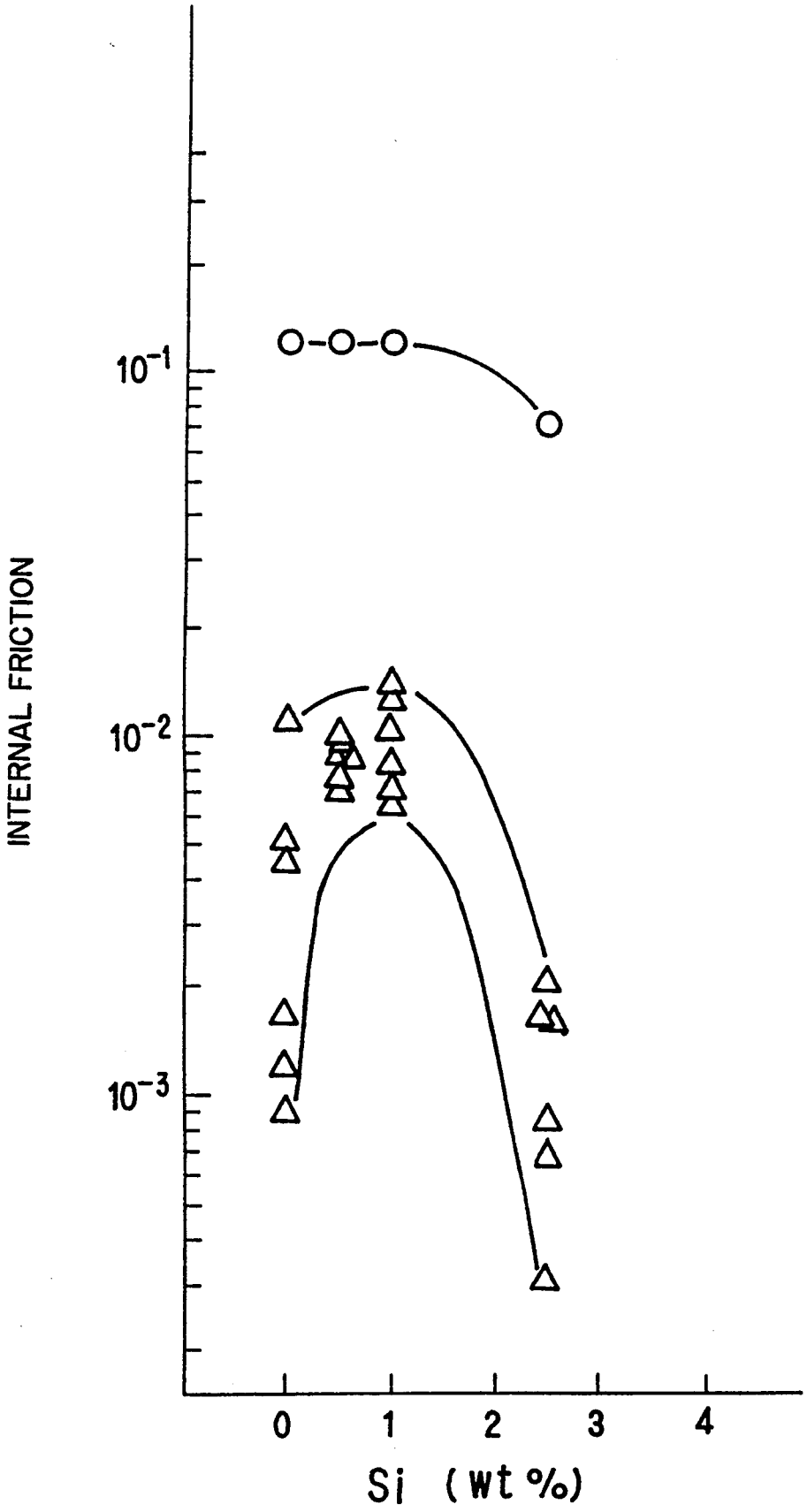
FIG. 8 is a diagram showing the values of internal friction as determined of an Fe—Al—Si alloy by the methods which will hereinafter be identified as (2) and (3), respectively.

FIG. 8 shows the internal friction as determined by other methods. It is obvious therefrom that the addition of Si is particularly effective in a region of a small strain amplitude.

Figure 1:
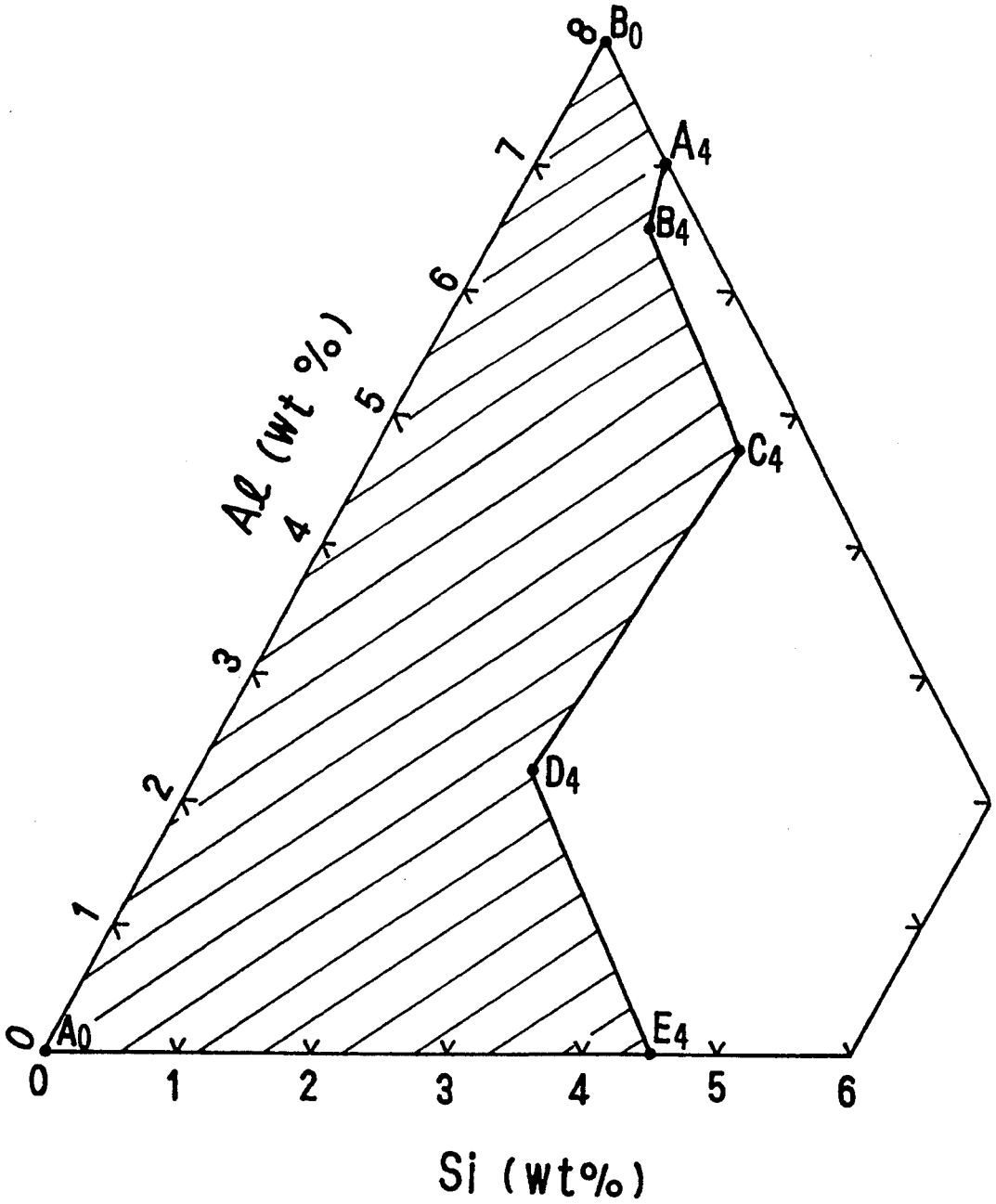
FIGS. 1 to 6 are diagrams defining the ranges of proportions of Al and Si in the alloy of this invention.
Figure 2:
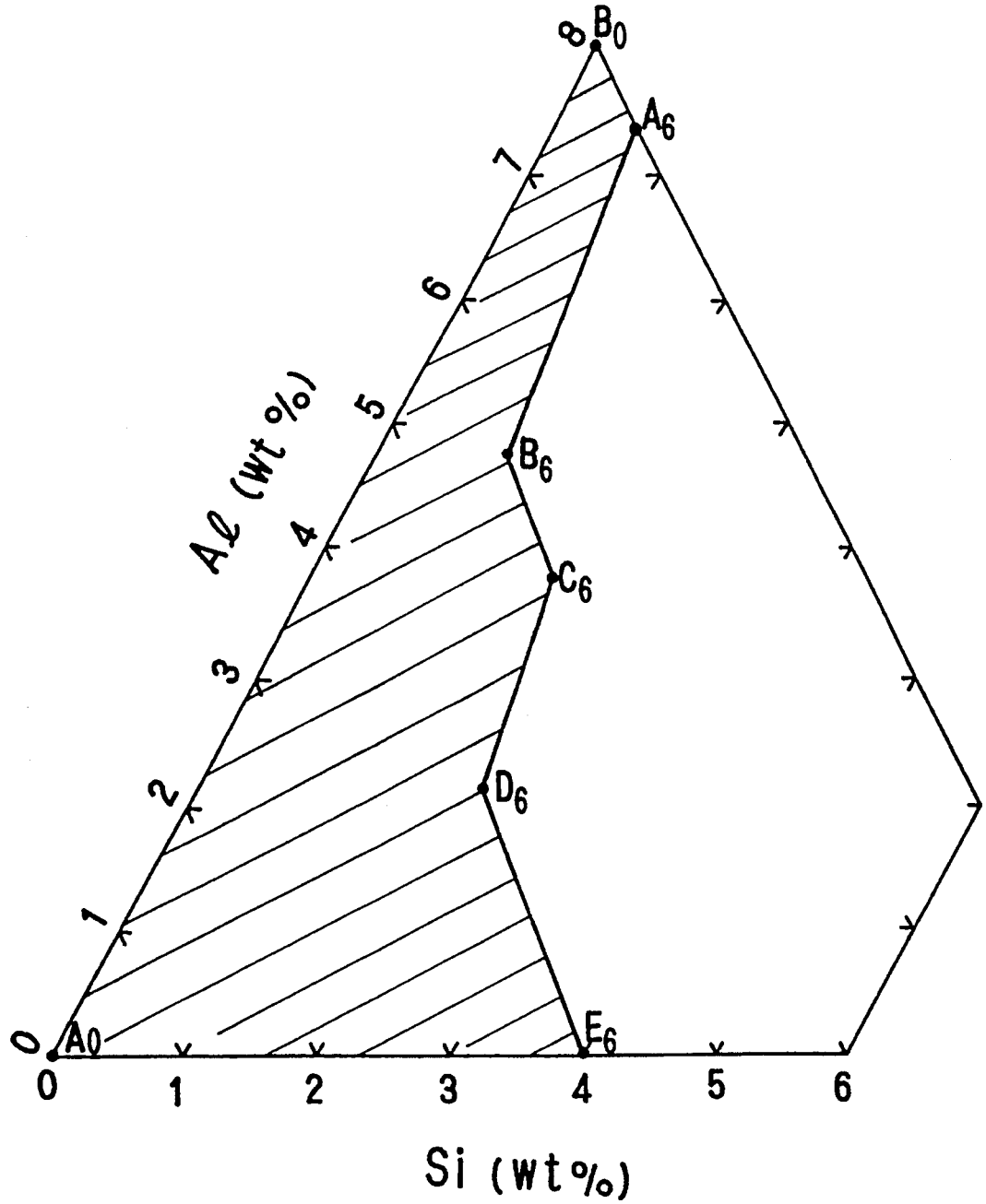
Figure 3:
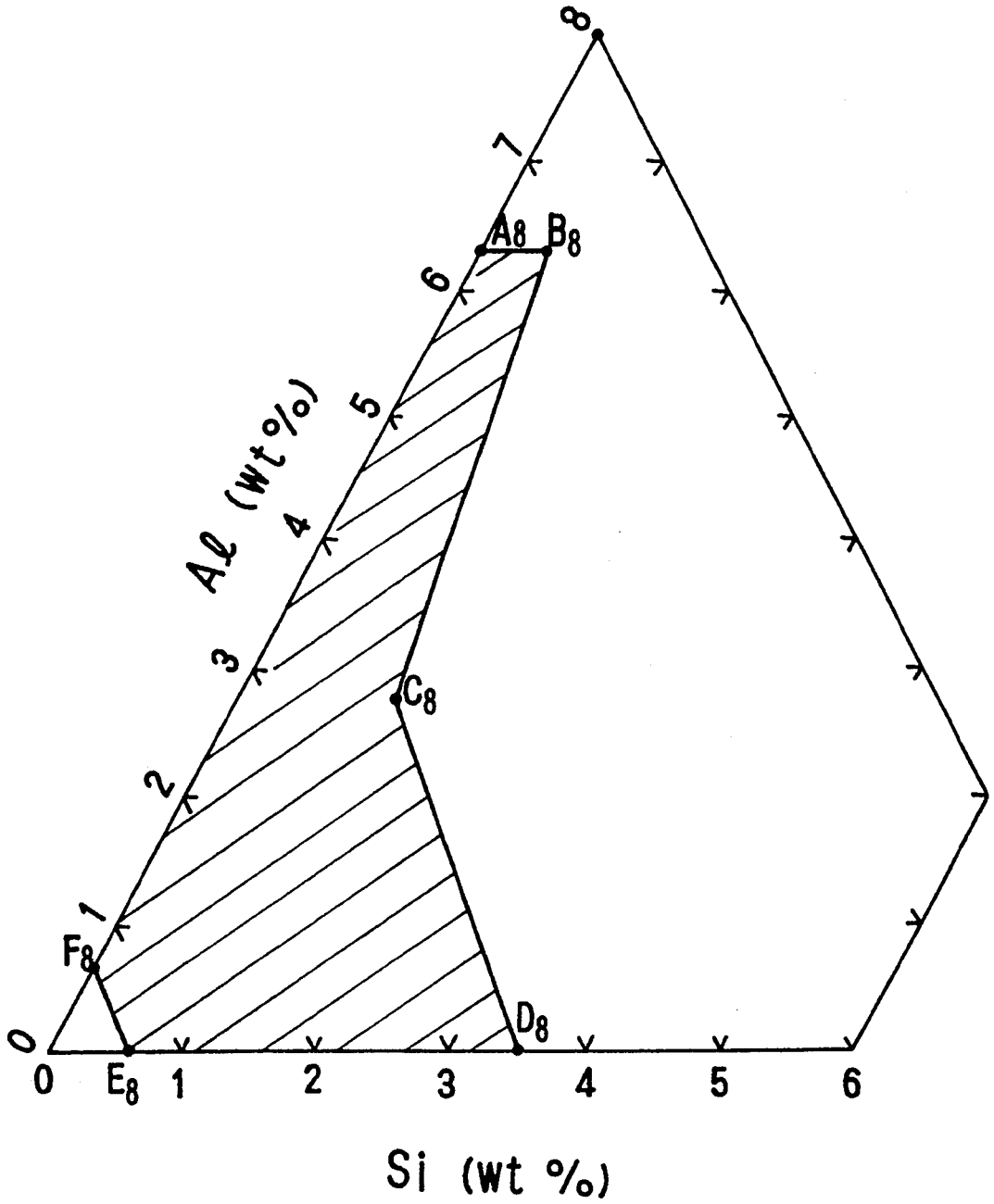
Figure 4:
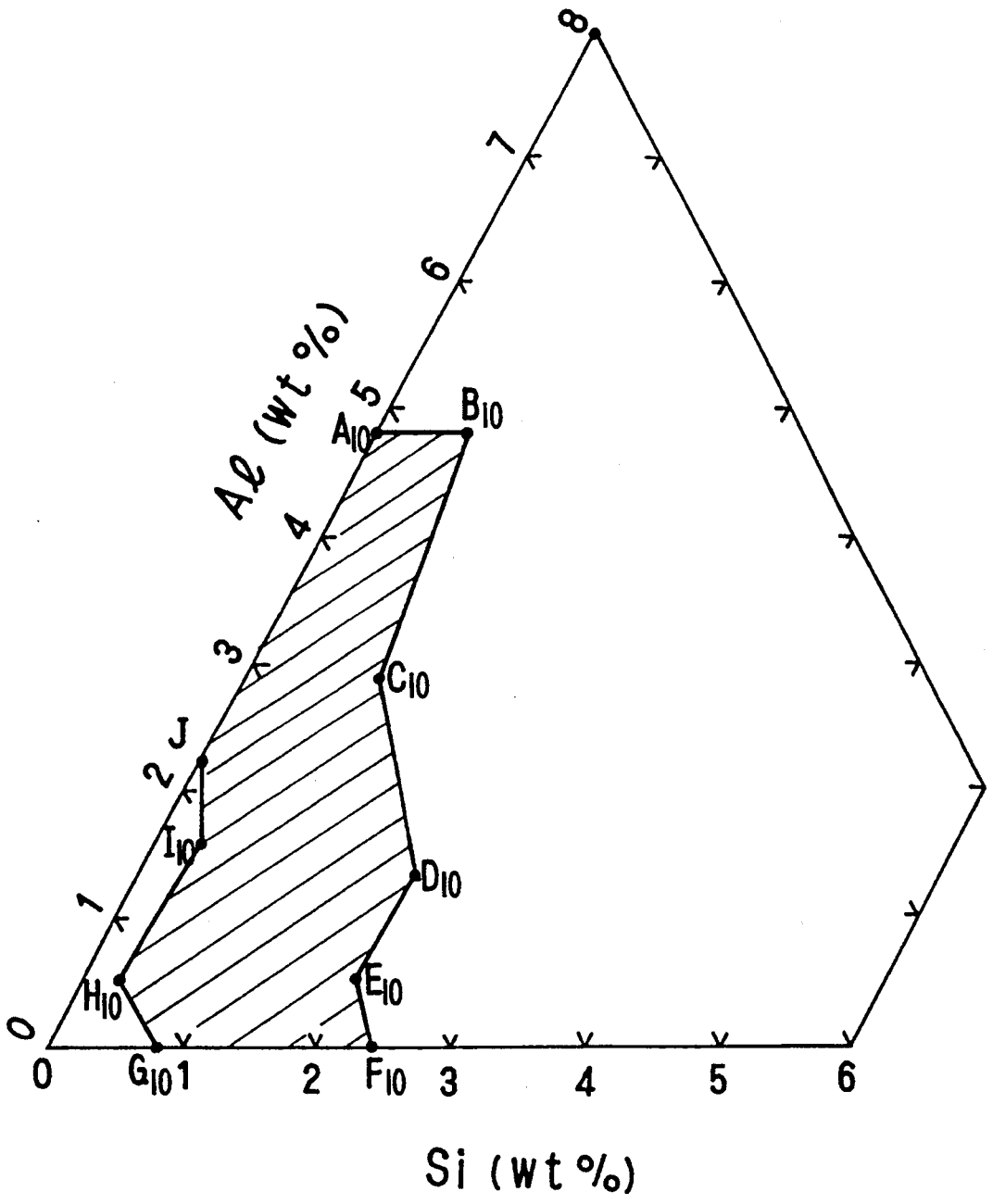
Figure 5:
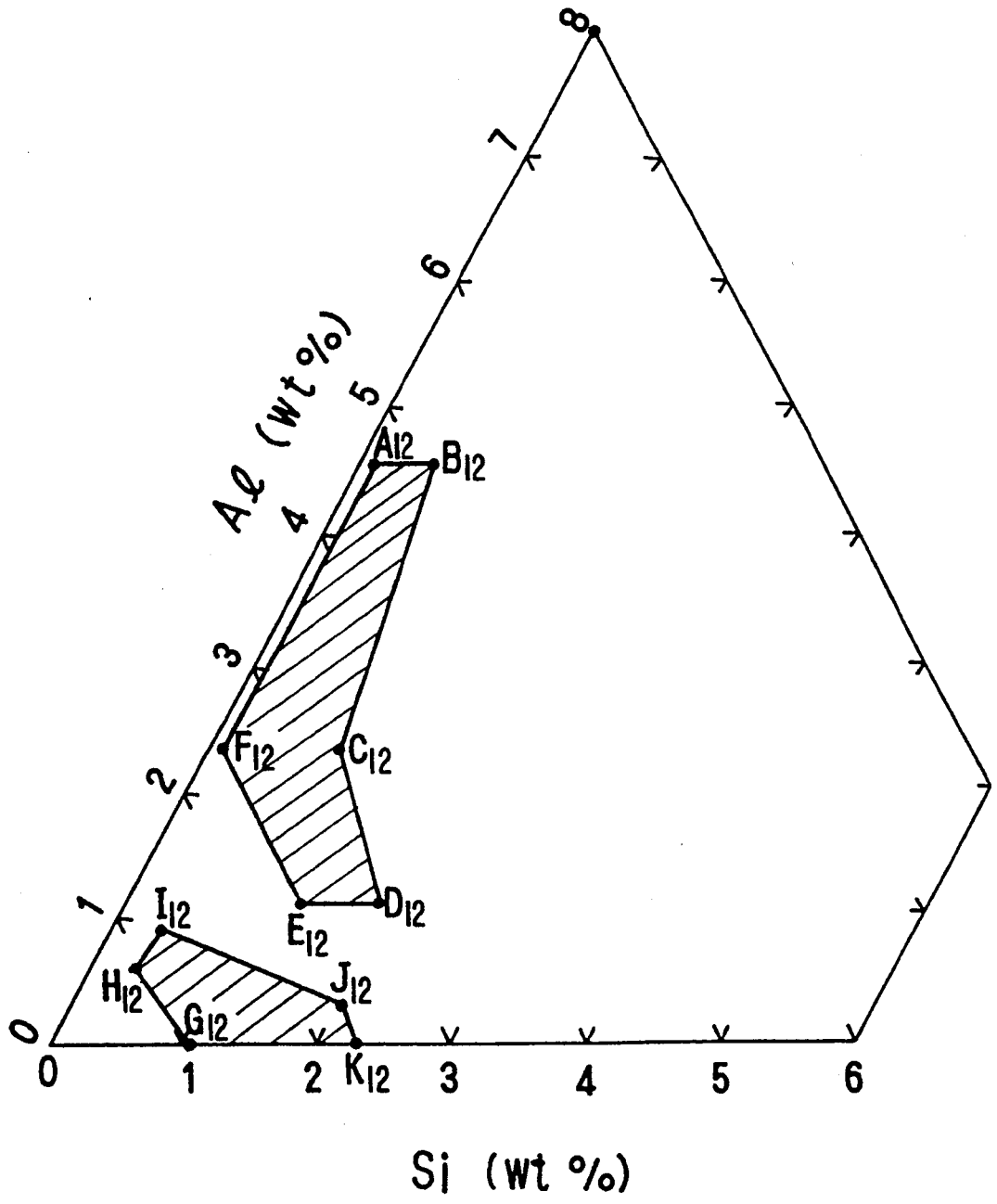
Figure 6:
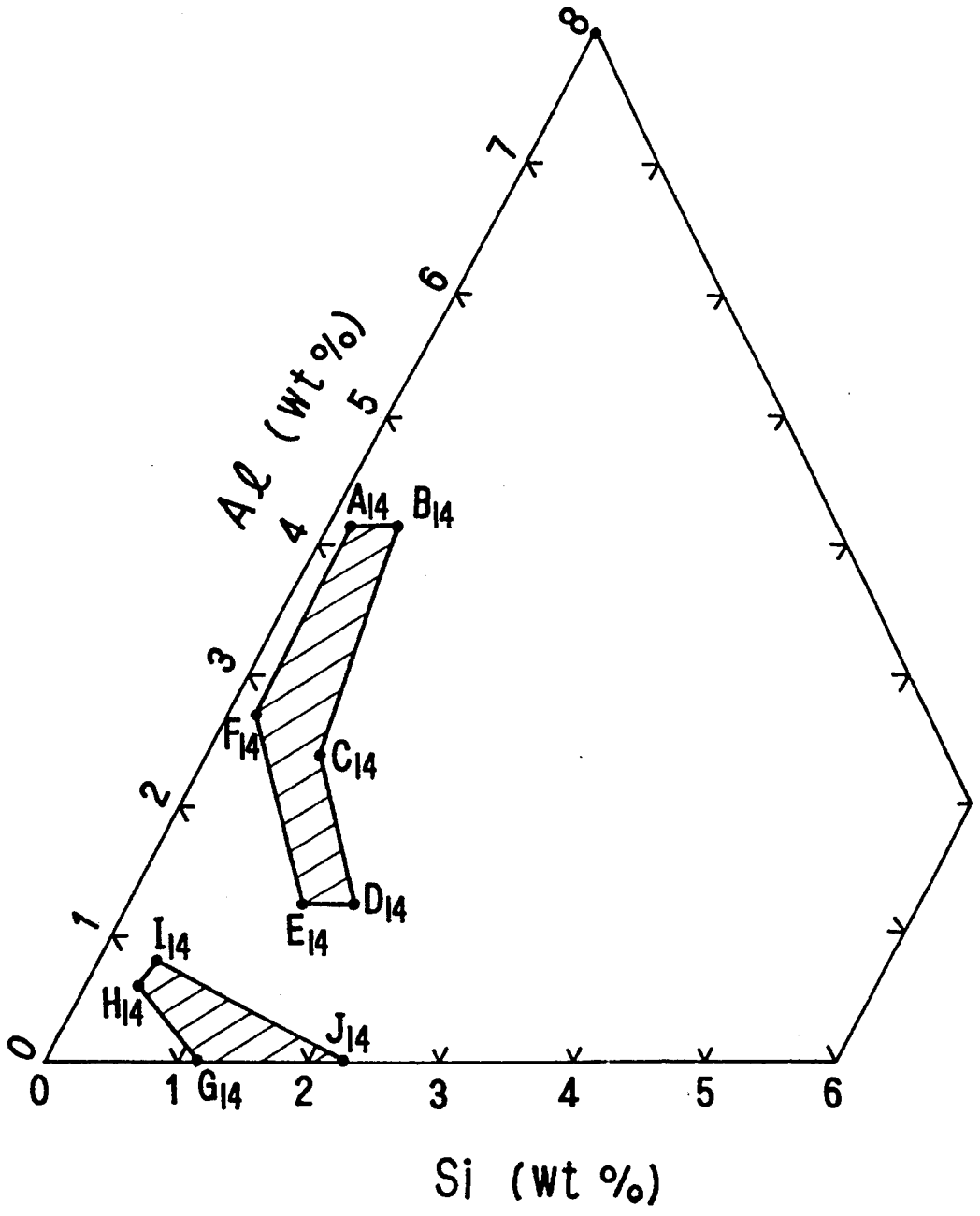

Based on the above results, this invention specifies the proportions of Al and Si as defined in FIG. 1 to attain a $Q^{-1}$ value exceeding $4\times10^{-3}$ as the vibration-damping properties of the alloy (the value of its internal friction), as defined in FIG. 2 to attain a $Q^{-1}$ value exceeding $6\times10^{-3}$, as defined in FIG. 3 to attain a $Q^{-1}$ value exceeding $8\times10^{-3}$, as defined in FIG. 4 to attain a $Q^{-1}$ value exceeding $1\times10^{-2}$, as defined in FIG. 5 to attain a $Q^{-1}$ value exceeding $1.2\times10^{-2}$, and as defined in FIG. 6 to attain a $Q^{-1}$ value exceeding $1.4\times10^{-2}$.

It is also obvious from FIG. 8 that it is desirable to add more than 0.5 wt. % Si to achieve improved vibration-damping properties in a region of a small strain amplitude. The addition of more than 0.5 wt. % Si is also desirable, since a slight variation in the composition of the alloy brings about a great difference in its properties if not more than 0.5 wt. % Si is added.

The alloy of this invention differs from what is proposed in Japanese Patent Publication No. 28982/1981 as hereinbefore referred to, and relies not upon the movement of dislocations, but upon the hysteresis resulting from the movement of magnetic domain walls, for absorbing vibration. Therefore, Mn has no effect in improving the vibration-damping properties of the material. The addition of 0.1 wt. % or more Mn is rather undesirable, as it lowers the machinability of the material and also increases the cost of steelmaking. Therefore, the alloy of this invention contains less than 0.1 wt. % Mn.

Limitations are also desirable on the other impurities for the reasons which will hereunder be set forth.

It is desirable to keep C at not more than 0.01 wt. %, since it is an element forming an interstitial solid solution and lowers the mobility of the magnetic domain walls and thereby the vibration-damping properties of the alloy.

It is also desirable to keep N at not more than 0.01 wt. %, since it lowers the vibration-damping properties of the alloy for the same reason as has been mentioned above with respect to carbon.

It is also desirable to keep O at not more than 0.01 wt. %, since it lowers the vibration-damping properties as C and N do.

It is desirable to keep P at not more than 0.01 wt. %, since it is segregated in the grain boundary of the alloy and lowers its workability.

It is desirable to keep S at not more than 0.01 wt. %, since it lowers the hot workability of the alloy.

The alloy of this invention has outstandingly high vibration-damping properties and is useful as a material for preventing vibration and noise.

EXAMPLES

The values of internal friction, $Q^{-1}$, of the alloys of this invention and comparative alloys having the chemical compositions shown in TABLES 1-a and 1-b (which contained 10 to 30 ppm of C, 2 to 26 ppm of N and 0.001 to 0.02 wt. % Mn) were determined as a measure of their vibration-damping properties. An ingot of each alloy made by casting the molten alloy in a mold had been heated to a temperature of 1200° C. to 1250° C., and hot rolled into a thickness of 6 mm. A sheet having a thickness of 0.8 mm, a width of 10 mm and a length of 100 mm had been cut from the rolled product, and annealed at 1050° C. in a vacuum to provide a specimen of each alloy. The specimen was caused to vibrate with free-free transverse vibration method in a vacuum, and a free vibration decay method was used to determine its internal friction method (1). The results are shown in TABLE 1.

FIG. 7 is a representation by contour lines of the values of internal friction of the Fe—Al—Si ternary alloys which are shown in TABLE 1. Each curve was drawn by plotting points of equal internal friction, and the numeral appearing in the square on each curve indicates the value of internal friction if it is multiplied by $10^{-3}$.

FIG. 8 shows the values of internal friction which were determined of some of the materials by the methods (2) and (3) which will hereunder be described:

Method (2): A sheet of each material having a thickness of 2 mm, a width of 15 mm and a length of 200 mm was annealed at 1050° C. in a vacuum, and caused to vibrate with free-free transverse vibration method, and mechanical impedance and resonance method was used to determine the value of its internal friction;

Method (3): The same specimens as those tested by method (2) were each cantilevered, and free vibration decay method was used to determine the value of its internal friction.

These methods make it possible to determine the values of internal friction of any material which correspond to various strain amplitudes. Method (2) is suitable for determination in a region of small amplitudes, and method (3) for determination in a region of large amplitudes. FIG. 8 shows the peak values of internal friction corresponding to various strain amplitudes [which were determined by method (3)], and the values of internal friction corresponding to a maximum strain amplitude, $\epsilon$, of $10^{-6}$ [which were determined by method (2)].

It is obvious from FIG. 8 that the addition of an appropriate proportion of Si to an Fe—Al alloy can stabilize its properties, particularly in a region of small amplitudes.

TABLE 1

| No. | Chemical composition (wt %) Al | Si | Internal friction $Q^{-1}$ ($\times 10^{-3}$) |
|---|---|---|---|
| 1 | 0.01 | 0.01 | 7.79 |
| 2 | 0.58 | 0.01 | 7.88 |
| 3 | 0.91 | 0.01 | 8.59 |
| 4 | 1.23 | 0.03 | 9.99 |
| 5 | 1.54 | 0.01 | 6.73 |
| 6 | 2.14 | 0.01 | 8.19 |
| 7 | 2.64 | 0.01 | 10.6 |
| 8 | 3.19 | 0.01 | 10.1 |
| 9 | 4.85 | 0.01 | 9.51 |
| 10 | 5.58 | 0.01 | 9.01 |
| 11 | 7.75 | 0.01 | 7.41 |
| 12 | 2.40 | 0.11 | 12.5 |
| 13 | 1.23 | 0.17 | 8.75 |
| 14 | 2.39 | 0.31 | 13.1 |
| 15 | 0.01 | 0.48 | 7.71 |
| 16 | 0.57 | 0.53 | 21.3 |
| 17 | 1.23 | 0.50 | 10.7 |
| 18 | 2.35 | 0.50 | 14.0 |
| 19 | 3.35 | 0.51 | 21.9 |
| 20 | 4.97 | 0.49 | 9.90 |
| 21 | 0.01 | 0.96 | 11.2 |
| 22 | 0.55 | 0.98 | 12.7 |
| 23 | 1.22 | 0.98 | 11.1 |
| 24 | 2.34 | 1.00 | 11.5 |
| 25 | 3.33 | 1.01 | 6.57 |
| 26 | 4.77 | 0.97 | 5.96 |
| 27 | 7.05 | 0.97 | 3.88 |
| 88 | 0.01 | 1.52 | 15.1 |
| 29 | 0.50 | 1.53 | 11.0 |
| 30 | 1.25 | 1.54 | 15.3 |
| 31 | 2.64 | 1.49 | 6.15 |
| 32 | 3.50 | 1.51 | 6.98 |
| 33 | 0.01 | 2.04 | 16.5 |
| 34 | 0.54 | 2.05 | 9.25 |
| 35 | 0.01 | 2.42 | 9.93 |
| 36 | 1.23 | 2.43 | 7.73 |
| 37 | 2.26 | 2.47 | 3.99 |
| 38 | 4.63 | 2.46 | 4.21 |
| 39 | 0.01 | 3.52 | 7.99 |
| 40 | 1.19 | 3.55 | 2.61 |
| 41 | 0.01 | 4.90 | 1.92 |

INDUSTRIAL UTILITY

The alloy of this invention is useful as a material for any component of a structure, machine, or the like that is required not to produce any vibration, or noise.

We claim:

1. A vibration-damping alloy containing not more than 0.01 wt. % C, not more than 0.01 wt. % N, not more than 0.01 wt. % O, not more than 0.01 wt. % P, not more than 0.01 wt. % S, those proportions of Al and Si which fall within the range defined in FIG. 3 by the lines connecting points $A_8$(Al: 6.30 wt. %; Si: 0 wt. %), $B_8$(Al: 6.30 wt. %; Si: 0.50 wt. %), $C_8$(Al: 2.75 wt. %; Si: 1.20 wt. %), $D_8$(Al: 0 wt. %; Si: 3.50 wt. %), $E_8$(Al: 0 wt. %; Si: 0.60 wt. %), and $F_8$(Al: 0.70 wt. %; Si: 0 wt. %), and less than 0.1 wt. % Mn, the balance of its composition being Fe and unavoidable impurities.

2. A vibration-damping alloy containing not more than 0.01 wt. % C, not more than 0.01 wt. % N, not more than 0.01 wt. % O, not more than 0.01 wt. % p, not more than 0.01 wt. % S, those proportions of Al and Si which fall within the range defined in FIG. 4 by the lines connecting points $A_{10}$(Al: 4.80 wt. %; Si: 0 wt. %), $B_{10}$(Al: 4.80 wt. %; Si: 0.70 wt. %), $C_{10}$(Al: 2.90 wt. %: Si: 1.00 wt. %), $D_{10}$(Al: 1.35 wt. %; Si: 2.05 wt. %), $E_{10}$(Al: 0.55 wt. %; Si: 2.00 wt. %), $F_{10}$(Al: 0 wt. %; Si: 2.40 wt. %), $G_{10}$(Al: 0 wt. %; Si: 0.80 wt. %), $H_{10}$(Al: 0.55 wt. %; Si: 0.25 wt. %), $I_{10}$(Al: 1.60 wt. %; Si: 0.35 wt. %) and $J_{10}$(Al: 2.25 wt. %; Si: 0 wt. %), and less than 0.1 wt. % Mn, the balance of its composition being Fe and unavoidable impurities.

3. A vibration-damping alloy containing not more than 0.01 wt. % C, not more than 0.01 wt. % N, not more than 0.01 wt. % O, not more than 0.01 wt. % P, not more that 0.01 wt. % S, those proportions of Al and Si which fall within the range defined in FIG. 5 by the lines connecting points $A_{12}$(Al: 4.55 wt. %; Si: 0.10 wt. %), $B_{12}$(Al: 4.55 wt. %; Si: 0.60 wt. %), $C_{12}$(Al: 2.35 wt. %; Si: 1.00 wt. %), $D_{12}$(Al: 1.10 wt. %; Si: 1.95 wt. %), $E_{12}$(Al: 1.10 wt. %; Si: 1.35 wt. %) and $F_{12}$(Al: 2.40 wt. %; Si: 0.10 wt. %), or points $G_{12}$(Al: 0 wt. %; Si: 1.05 wt. %), $H_{12}$(Al: 0.60 wt. %; Si: 0.35 wt. %), $I_{12}$(Al: 0.90 wt. %; Si: 0.40 wt. %), $J_{12}$(Al: 0.30 wt. %; Si: 2.05 wt. %) and $K_{12}$(Al: 0 wt. %; Si: 2.30 wt. %), and less than 0.1 wt. % Mn, the balance of its composition being Fe and unavoidable impurities.

4. A vibration-damping alloy containing not more than 0.01 wt. % C, not more than 0.01 wt. % N, not more than 0.01 wt. % O, not more than 0.01 wt. % P, not more than 0.01 wt. % S, those proportions of Al and Si which fall within the range defined in FIG. 6 by the lines connecting points $A_{14}$(Al: 4.15 wt. %; Si: 0.20 wt. %), $B_{14}$(Al: 4.15 wt. %; Si: 0.60 wt. %), $C_{14}$(Al: 2.30 wt. %; Si: 0.90 wt. %), $D_{14}$(Al: 1.20 wt %; Si: 1.75 wt %), $E_{14}$(Al: 1.20 wt %; Si: 1.35 wt %) and $F_{14}$(Al: 2.70 wt. %; Si: 0.20 wt. %), or points $G_{14}$(Al: 0 wt. %; Si: 1.15 wt. %), $H_{14}$(Al: 0.60 wt. %: Si: 0.40 wt. %), $I_{14}$(Al: 0.80 wt. %; Si: 0.45 wt. %), $J_{14}$(Al: 0 wt. %; Si: 2.20 wt %), and less than 0.1 wt. % Mn, the balance of its composition being Fe and unavoidable impurities.

5. A vibration-damping alloy as set forth in claim 1, 2, 3, or 4, wherein said proportion of Si is more than 0.5 wt. %.

* * * * *